US009038543B2

(12) United States Patent
Beutler

(10) Patent No.: US 9,038,543 B2
(45) Date of Patent: May 26, 2015

(54) AMUSEMENT RIDE COMPRISING A FACIAL EXPRESSION RECOGNITION SYSTEM

(75) Inventor: Joerg Beutler, Holzkirchen (DE)

(73) Assignee: MAURER SOEHNE GMBH & CO. KG, Munich (DE)

( * ) Notice: Subject to any disclaimer, the term of this patent is extended or adjusted under 35 U.S.C. 154(b) by 584 days.

(21) Appl. No.: 12/691,323

(22) Filed: Jan. 21, 2010

(65) Prior Publication Data

US 2011/0174189 A1 Jul. 21, 2011

(51) Int. Cl.

| | |
|---|---|
| ***A63G 1/00*** | (2006.01) |
| ***G06K 9/00*** | (2006.01) |
| ***A63G 7/00*** | (2006.01) |
| ***A63G 4/00*** | (2006.01) |

(52) U.S. Cl.

CPC .. *A63G 7/00* (2013.01); *G06K 9/00* (2013.01); *A63G 4/00* (2013.01)

(58) Field of Classification Search

USPC ..... 104/53, 84, 85; 246/108, 166.1, 167, 246/185, 191; 382/115–119

See application file for complete search history.

(56) References Cited

U.S. PATENT DOCUMENTS

| | | | | |
|---|---|---|---|---|
| 6,819,783 | B2 * | 11/2004 | Goldberg et al. | 382/115 |
| 7,561,723 | B2 * | 7/2009 | Goldberg et al. | 382/115 |
| 2008/0251575 | A1 * | 10/2008 | Bowling et al. | 235/375 |
| 2009/0298603 | A1 * | 12/2009 | Crawford | 472/137 |

* cited by examiner

*Primary Examiner* — Robert McCarry, Jr.

(74) *Attorney, Agent, or Firm* — Locke Lord LLP; Jeffrey D. Hsi

(57) ABSTRACT

The amusement ride 1 comprises a track 2 and a vehicle 3 being moveable along the track 2 at a velocity v. Within the vehicle 3 a video camera 4 is installed. The video camera 4 takes a video film of the face of a passenger received within the vehicle 3 during a ride. A sender 5 transmits the data 6 to a facial expression recognition system 7. The result 10 of the process carried out by facial expression recognition system 7 may be downloaded from a server 11 by a client 13.

12 Claims, 2 Drawing Sheets

AMUSEMENT RIDE COMPRISING A FACIAL EXPRESSION RECOGNITION SYSTEM

BACKGROUND OF THE INVENTION

1. Technical Field

The present invention relates to an amusement ride comprising: a track; and a vehicle for receiving at least one passenger and for movement of the vehicle along said track. Furthermore, the present invention relates to a method of operating an amusement ride, comprising a step of recording images of the face of a passenger received in an amusement ride vehicle during a ride.

2. State of the Art

In amusement parks various types of rides are offered. High-speed rides, like e.g. roller coasters, are particularly popular.

State of the art roller coasters comprise a drive track on which vehicles are typically arranged e.g. as trains and moved on the rails along the drive track. The drive track comprises different sections. Some of the sections are smooth, others are a thrill. Some of them are arranged at a high level, others at a lower level. The speed of the vehicle usually changes during the ride. Therefore, the passengers experience the ride with changing emotions and reactions (e.g. tension, joy, fear, laughter, screaming, being relaxed, etc.).

When the ride is finished the passengers disembark with impressions of the ride. Some of the passengers may repeat the ride. After the last ride the passengers may have some positive feelings, impressions and memories of the amusement ride. However, there is no lasting record or souvenir to bring back emotions, feelings, impressions and a memory of the ride later. So, after a while, the passengers may forget about the ride.

In order to give the passengers a lasting record of the ride some amusement rides offer to take a photograph of the passenger in a particular track section of the ride. It is also possible to install a video camera to take a film sequence of the passenger during the ride. However, the passengers may want to have personal or informational details after their ride.

SUMMARY OF THE INVENTION

It is an object of the present invention to provide an amusement ride and a method of operating an amusement ride enabling the passengers to retrieve additional information after the ride.

This object is achieved by providing an amusement ride according to claim 1 and a method of operating an amusement ride according to claim 8. Preferred embodiments of the invention are subject of the dependent claims.

An inventive amusement ride comprises: a track; a vehicle for receiving at least one passenger and for movement of the vehicle along said track; an image recording device for recording images of the face of the passenger received in said vehicle during a ride; and a facial expression recognition system for analysing the recorded images of said facial expression of said passenger.

The track may be configured in various patterns. It may comprise rails for guiding the vehicle(s) along the track during a ride.

The vehicle may be a vehicle for a single or a plurality of passengers, e.g. a train. The passengers sit in the vehicle(s). When passing different sections of the track the passengers show a sequence of emotions on their faces. For example, the enjoyment of the ride or the tension of a passenger may be enhanced in spectacular curves, declines, or inversions.

Each of the vehicles is provided with a video camera or a plurality of vide cameras for recording the face of one of the passengers during a ride. The camera records a plurality of images of the face or a sequence of images (e.g. a video film) while the vehicle moves along the track. It is preferred that there are more than two cameras installed for recording facial expressions of a passenger. The cameras may be installed in the vehicle or along the track.

Furthermore, the facial expression recognition system includes, for instance, an image-processing apparatus for executing facial expression recognition. After the facial expression recognition is finished the output of the facial expression recognition system (e.g. a table showing the classification of the facial expression at various points along the track) may be analyzed and further processed to receive a result which may be output in a predetermined form. For example, the result may comprise the film of the ride combined with an illustration of the corresponding facial expressions (e.g. degree of tension) extracted from the facial expression of the passenger during the ride. The result may, for example, be output as a chart combined with the images of the ride, or a description field combined with the images of the ride indicating the kind and/or intensity of the facial expression.

The facial expression recognition system may comprise a processor executing facial expression recognition software applied to recorded images of the face of a passenger during a ride. The processor processes a sequence of frontal images of moving passengers' faces. The software includes algorithms that are capable of processing images in order to recognize a passenger's facial expressions in real time and categorize them as one of a plurality of prototype expressions, e.g. fear, joy, surprise, etc. The algorithm is capable of recognizing the passenger's facial expression. The software can be applied to video sequences recorded during a ride. The facial expressions are determined by comparison with expressions captured and stored in a facial database.

It is preferred that the amusement ride comprises an output unit for outputting at least one result of said analysis of the facial expression of the passenger.

The output unit may comprise a display for displaying at least one result of the analysis of the facial expression of the passenger. I. e. the output may be a visual result of the analysis of the facial expression recognition system. The result may be output e.g. as an illustration, a report, a summary or as a graphic of the sequence of categorized visual expressions during the ride. For example, the output may include different symbols for any of the categorized expressions.

The output unit may comprise a printing device for printing at least one result of said analysis of the facial expression of the passenger. A passenger may, after a ride, receive a printout of a sequence of categorized facial expressions.

It is preferred that the facial expression recognition system comprises a memory device and software stored in said memory device, wherein said software is configured for analysing the facial expression of the passenger.

The amusement ride may comprise a central storage unit comprised in a network, wherein the central storage unit receives and stores data generated by said facial expression recognition system. The storage may be part of a website server accessible by a client through a personal computer. The network may be a wired network or a wireless network. It is preferred that the network is a global network, e.g. the internet.

In another embodiment of the invention the amusement ride may comprise a storage provided in said amusement ride. It may be provided in the vehicle or near the track of the amusement ride.

The data may be accessible for the passenger after the ride from different locations at various times. For example, a passenger may retrieve or download the data of his ride stored in the storage via the internet.

A method of operating an amusement ride according to the invention comprises the steps of: a) recording images of the face of a passenger received in an amusement ride vehicle during a ride of the vehicle; and b) recognizing a facial expression of the passenger.

Step a) may include recording one or a plurality of images at different points along the track or a sequence of images, e.g. a film, during the ride. Step b) may include applying an algorithm to the recorded images and analyzing the result by using a facial database.

It is preferred that the method includes analysing the facial expression of the passenger.

The method includes a step c) of outputting at least one result of said analysis of the facial expression of the passenger.

The method step c) may include outputting a visual result of said analysis of the facial expression of the passenger, e.g. an illustration, a sequence of images or a film sequence combined with an illustration of a sequence of facial expressions analyzed by a facial expression recognition system in step b).

It is preferred that the method step c) includes displaying the result of the analysis of the facial expression of the passenger.

The method step c) includes printing the result of said analysis of the facial expression of the passenger.

The method may include a step of storing the result of the facial expression analysis in a storage. The storage may be a central storage comprised in a network, wherein the central storage unit receives and stores data generated by said facial expression recognition system.

It is preferred that the method includes a step of providing stored data in a network for retrieval or downloading of the data by the passenger.

BRIEF DESCRIPTION OF THE DRAWINGS

For a better understanding of the invention reference will now be made to the accompanying drawings.

DETAILED DESCRIPTION OF THE INVENTION

Figure 1:
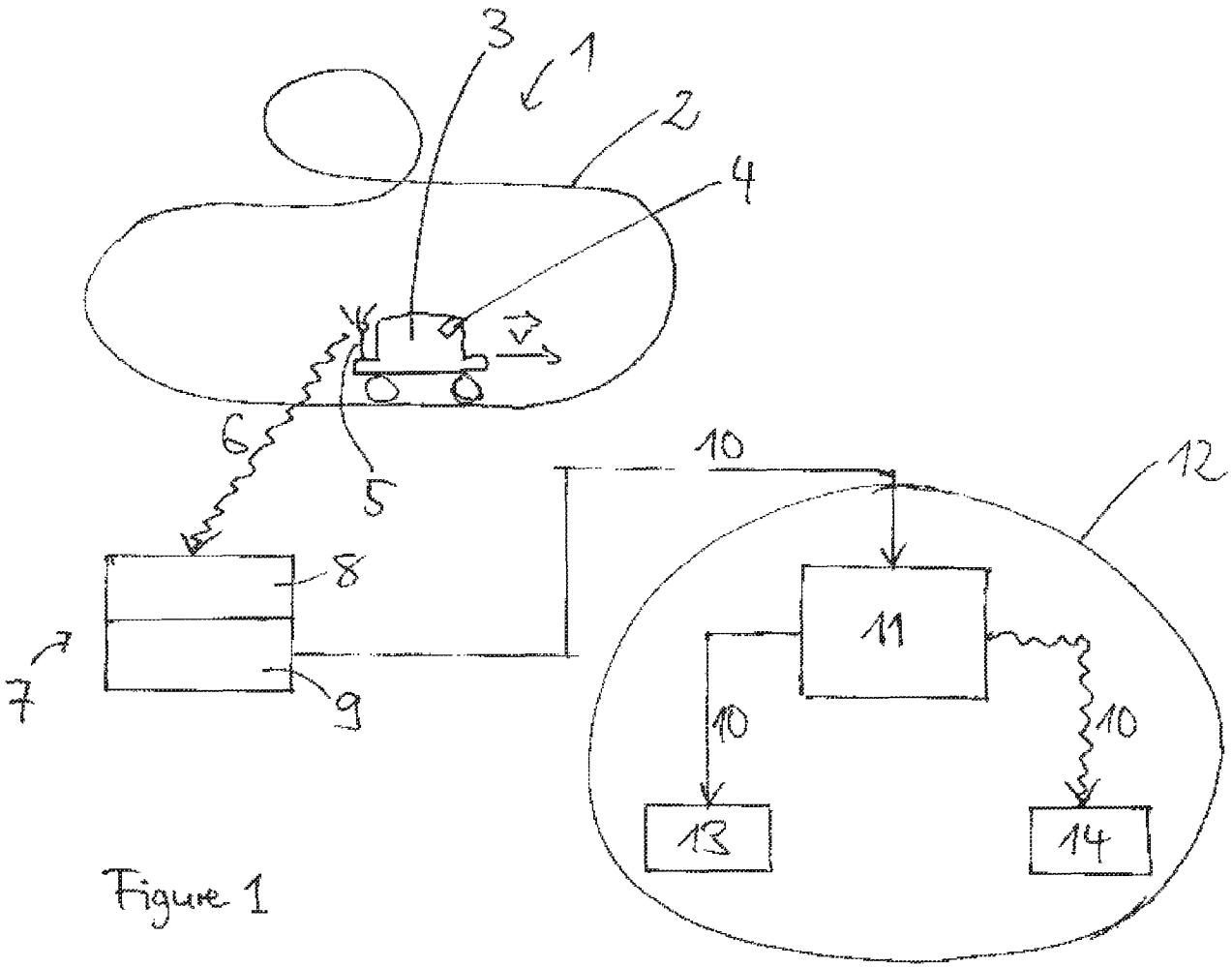
FIG. 1 illustrates an amusement ride according to the invention.

Reference is made to FIG. 1 showing an amusement ride 1 according to the invention.

The amusement ride 1 comprises a track 2 and a vehicle 3 being moveable along the track 2 at a velocity v. Within the vehicle 3 a video camera 4 is installed. The video camera 4 takes a video film of the face of a passenger received within the vehicle 3 during a ride.

In the embodiment shown in FIG. 1 the vehicle 3 comprises a sender 5 for sending the data 6 recorded by the video camera 4 via wireless transfer. In an alternative embodiment (not shown) the video film recorded by the video camera 4 may be transmitted to a storage after the ride (e.g. via wireless connection or a cable connection).

The sender 5 transmits the data 6 to a facial expression recognition system 7. The facial expression recognition system 7 comprises a processor 8 and a memory 9. The processor 8 processes the data 6 received from the vehicle 3 by carrying out a facial expression recognition method as described later in connection with FIG. 2. The method includes executing an algorithm which allows a classification of the facial expression of a passenger during a ride in different sections of the track 2. The memory 9 is used as a cache for storing the transmitted data 6. Furthermore, the memory 9 may be used for storing software (particularly facial expression recognition software), a facial database, the output of the processor 8 after carrying out facial expression recognition, and the results received after analyzing and/or further processing the output of the processor 8.

The output may be tables showing the classification/categorization of the facial expressions of passengers in different sections of the track 2. The output may be combined with the video film data 6. E. g. the output of the facial expression recognition method may be illustrated in a text or graphic and included in the video film. While watching the film a passenger receives information about the classification/categorization of his facial expression during the ride and in combination with a particular film sequence. Of course, the facial expression may change during the ride, so the text or graphic will change.

The result 10 (e.g. a combination of film data and the output of the facial expression recognition method) is uploaded on a central server 11 which is part of a global network 12. A client in the global network 12 may download the data 10 from the server 11. The client may have to use a password, a code or any other permission for the access to particular data, e.g. to the result 10 of a particular ride and passenger. The passenger may receive the permission information after a ride within the vehicle 3, e.g. by way of a printout.

The network 12 includes various clients, e.g. a personal computer 13 connected to the server 11 via a cable connection, and a mobile station 14 having a wireless connection to the server 11.

Figure 2:
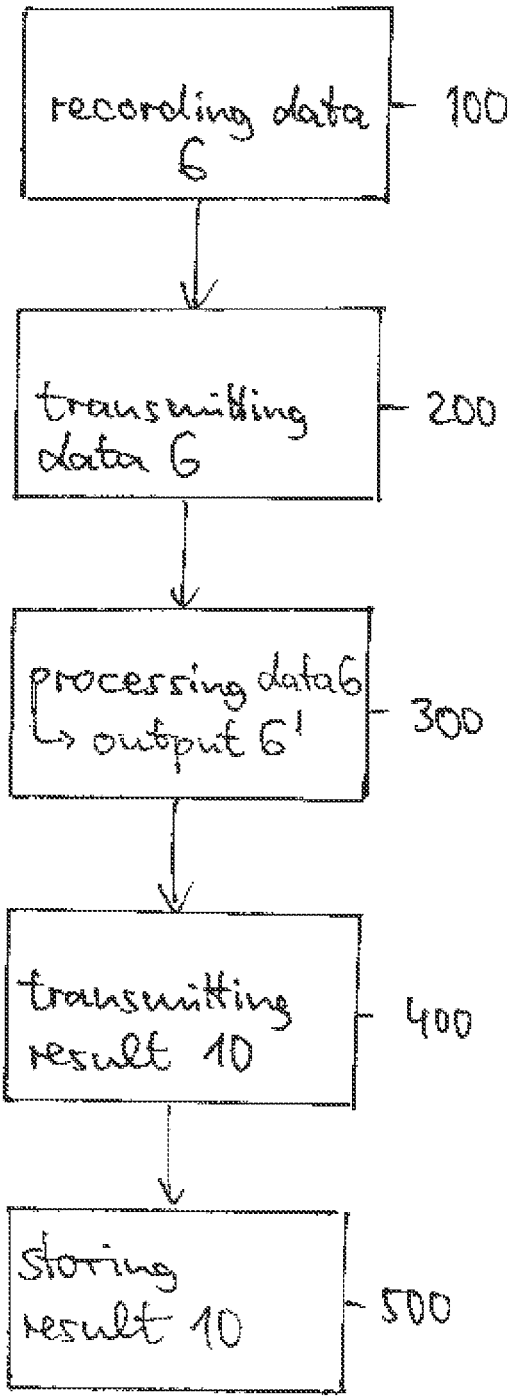
FIG. 2 is a flow chart showing the method of operating an amusement ride according to the invention.

A method of operating an amusement ride 1 according to the invention is illustrated in FIG. 2.

First, the ride starts by moving a vehicle along a track of the amusement ride. After or when starting the ride a video camera installed in the vehicle starts recording a video film (data 6) of the facial expression of a passenger. In a first step 100, during the ride, a video film is recorded of the facial expression of the passenger.

During or after the ride, in a second step 200, the data 6 is transmitted to a facial expression recognition system.

In a third step 300 in the facial expression recognition system the data 6 are processed and an output 6' is generated by applying an algorithm to the data 6 which classifies the facial expressions during the ride in different categories. In order to receive a result 10, the output 6' may be combined with the data 6.

In a fourth step 400 the result 10 is transmitted to a central server and stored on the server in a fifth step 500.

There are various possibilities for a passenger to access the result 10. In a first embodiment, after the ride, permission/authorization information, e.g. a password, is generated and output to the passenger for allowing access to the result 10 stored on the server. The passenger may retrieve the result 10 from the server after the ride to a mobile station or at home to a personal computer. For example, the passenger, after entering the password, may download the result 10 from a website of the amusement ride operator.

In a second embodiment, the result 10 is not transmitted to a server and stored on the server. So steps 400 and 500 of FIG. 2 are replaced by outputting the result directly after the ride, e.g. by showing the result 10 on a display (installed in the vehicle or near the track) or outputting a printout of the result 10 (from a printer installed in the vehicle or near the track) after the ride.

The first embodiment and the second embodiment may as well be combined.

I claim:

1. An amusement ride comprising:

a track;

a vehicle for receiving at least one passenger and for movement of the vehicle along said track;

at least one video camera installed in the vehicle, the at least one video camera configured to record a film of the face of the at least one passenger in said vehicle from a start of a ride and continuing during the ride;

a facial expression recognition system for analyzing said passenger's facial expression recorded in said film; and an output unit for outputting a result of said analysis of the facial expression of the passenger, wherein the result includes a classification of the facial expression at various points along the track.

2. The amusement ride of claim 1, wherein said output unit comprises a display for displaying at least one result of said analysis of the facial expression of the passenger.

3. The amusement ride of claim 1, wherein said output unit comprises a device for printing at least one result of said analysis of the facial expression of the passenger.

4. The amusement ride of claim 1, wherein said facial expression recognition system comprises a memory device and software stored in the memory device, wherein said software is configured for analyzing the facial expression of the passenger.

5. The amusement ride of claim 1, said amusement ride comprises a storage unit comprised in a network, wherein said storage unit receives and stores a result generated by said facial expression recognition system.

6. The amusement ride of claim 5, said result is accessible for the passenger after the ride from different locations at various times.

7. A method of operating an amusement ride, comprising the steps of:

providing an amusement ride vehicle for receiving at least one passenger, the amusement ride vehicle including at least one video camera installed in the vehicle;

recording a film of the face of the at least one passenger received in the amusement ride vehicle from a start of a ride and continuing during the ride of said vehicle along a track using the at least one video camera;

recognizing a facial expression of said passenger from analyzing facial expressions recorded in said film; and outputting a result of said analysis of the facial expression of the passenger, wherein the result includes a classification of the facial expression at various points along the track.

8. The method of claim 7, wherein the step of outputting the result includes outputting a visual result of said analysis of the facial expression of the passenger.

9. The method of claim 8, wherein the step of outputting the result includes displaying said analysis of the facial expression of the passenger.

10. The method of claim 8, wherein the step of outputting the result includes printing the result of said analysis of the facial expression of the passenger.

11. The method of claim 7, wherein said method includes the step of storing said result of said facial expression analysis in a storage.

12. The method of claim 11, wherein said method includes a step of providing stored data in a network for retrieval or downloading of the data by the passenger.

* * * * *